US006572491B2

(12) United States Patent
Hasebe et al.

(10) Patent No.: US 6,572,491 B2
(45) Date of Patent: Jun. 3, 2003

(54) GOLF CLUB HEAD

(75) Inventors: Yuu Hasebe, Tokyo (JP); Hirato Shimasaki, Tokyo (JP); Makoto Kubota, Tokyo (JP); Daisuke Mikame, Saitama-ken (JP); Yasunori Imamoto, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/804,194

(22) Filed: Mar. 13, 2001

(65) Prior Publication Data

US 2001/0007837 A1 Jul. 12, 2001

Related U.S. Application Data

(62) Division of application No. 09/238,829, filed on Jan. 28, 1999, now Pat. No. 6,254,494.

(30) Foreign Application Priority Data

Jan. 30, 1998 (JP) ..... 10-034008
May 12, 1998 (JP) ..... 10-128792

(51) Int. Cl.[7] ..... A63B 53/04
(52) U.S. Cl. ..... 473/349; 473/345
(58) Field of Search ..... 473/334, 340, 473/341, 345, 349

(56) References Cited

U.S. PATENT DOCUMENTS

| | | | | |
|---|---|---|---|---|
| 4,432,549 A | * | 2/1984 | Zebelean | |
| 5,271,621 A | * | 12/1993 | Lo | |
| 5,411,255 A | * | 5/1995 | Kurashima et al. | |
| 5,658,207 A | * | 8/1997 | Aizawa et al. | 473/345 |
| 5,755,624 A | * | 5/1998 | Helmstetter | 473/291 |
| 5,755,627 A | * | 5/1998 | Yamazaki et al. | 473/345 |
| 5,797,176 A | | 8/1998 | Rose et al. | 473/341 X |
| 5,935,019 A | | 8/1999 | Yamamoto | 473/345 X |
| 5,961,394 A | | 10/1999 | Minabe | 473/345 X |
| 5,967,905 A | | 10/1999 | Nakahara et al. | 473/349 X |
| 6,010,411 A | * | 1/2000 | Reyes | 473/345 |

* cited by examiner

*Primary Examiner*—John A. Ricci
(74) *Attorney, Agent, or Firm*—Sughrue Mion, PLLC

(57) ABSTRACT

A golf club head having a hollow construction, including a bar-like gravity adjusting piece (4) which extends longitudinally from a toe (7) towards a heel (8), or vice versa, of the head and is secured directly on an inner surface of a sole portion (2) in a position nearer to a front face (3) or wherein a forward half area (F) of the sole portion (2) as viewed from above, that is nearer to a face member (3') of the head, has a thickness two or more times greater in at least a portion thereof than an average thickness of a rearward half area (R) of the sole portion, that is nearer to a back side (10).

9 Claims, 5 Drawing Sheets

GOLF CLUB HEAD

This is a divisional of application Ser. No. 09/238,929 filed Jan. 28, 1999, now U.S. Pat. No. 6,254,494 the disclosure of which is incorporated herein by reference.

BACKGROUND OF THE INVENTION

1. Field of the Invention

The present invention generally concerns a golf club head. More particularly, the present invention relates to an optimally positioning the center of gravity of a hollow-construction golf club head made of a metallic material such as titanium, titanium alloy, stainless steel or similar.

2. Description of the Prior Art

It can be said that the performance of a golf club head, namely, the ball distance traveled and traveling direction, greatly depends upon the position of the center of gravity and moment of inertia of the golf club head. Recently, there are many available types of golf club heads made of metallic materials having high specific strength, respectively, and each having an increased volume and reduced weight. In these situations, many proposals have been made to review and improve the shape and structure of the golf club heads in connection with the problems of the center of gravity position and the moment of inertia.

Generally, geometry of golf club head center of gravity includes parameters such as gravity height, depth and distance (a minimum distance of the center of gravity from the extension of the shaft axis), etc. Therefore, a metallic golf club head of the hollow-construction is designed with major consideration to such parameters of center of gravity to optimally position the center of gravity for a player's skill and usage of the golf club.

Indeed, the conventional golf club heads manufactured based on the above proposals, for example, hollow-configuration large or "jumbo" heads made of such a metal having a high specific strength as titanium, for example, had implemented an increased inertia of moment about the center of gravity and also increased spins of a golf ball struck with such a golf club head, thereby allowing average skilled golfers to enjoy an easier swinging of the golf club and increased distance of ball flight. For these purposes, the golf club head was designed for the center of gravity to be lower and deeper in the head. The golf club with such a head will perform it designed function when used by an average skilled golf player who can swing the club at a speed that is not so high. However, when a golf ball is struck with such a golf club by golfers having middle and upper grades of skill who can swing the club head at a higher speed and at a high ratio of meeting the sweet area of the head, too much back spin will be imparted to the golf ball more frequently when unnecessary, which is not any advantage for the skilled players.

Also, if the entire sole portion of the head is designed rather more thicker than the rest to have a low gravity, the vertical moment of inertia of the head about an axis passing through the head center of gravity and parallel to the ground will be unbalanced, so that striking a golf ball at an upper portion of the front face will possibly result in a direction of ball flight not intended or a high, weak ball not traveling a long distance. Also even if other than the sole portion is designed to be more lightweight by thinning of the wall, using a lighter material or otherwise, the head has to be balanced by distributing, to the sole portion, most of the corresponding weight thus reduced, thus the head cannot be designed to be larger.

Furthermore, it has been proposed to position only the center of gravity nearer to the front face of the golf club head. In this case, however, since no consideration is given to the gravity height, the center of gravity is positioned higher as it is placed nearer to the front face of the head. The golf club head thus designed will have characteristics suitable only for the highly skilled golf players including professional golfers.

SUMMARY OF THE PRESENT INVENTION

Accordingly, the present invention has an object to overcome the above-mentioned drawbacks of the prior art by providing a golf club head having a low gravity maintaining in balance the moments of inertia in different directions and characteristics suitable for many different golfers ranging in grade of skill from average to upper levels.

According to the present invention, there is provided a golf club head of 250 cc or more in volume and having a hollow construction, including a bar-like gravity adjusting piece extending longitudinally from a toe towards a heel, or vice versa, of the head and secured directly on an inner surface of a sole portion in a position nearer to a front face.

According to the present invention, there is also provided a golf club of 250 cc or more in volume and having a hollow construction, including three gravity adjusting pieces: a piece (A) secured directly on an inner surface of a sole portion of the head in a position nearer to a toe portion, a piece (B) secured directly on the sole inner surface in a position nearer to a back side of the head, and a piece (C) secured directly on the sole inner surface in a position nearer to a heel portion, these gravity adjusting pieces being in a weight relationship of $A+B \leqq C$.

According to the present invention, there is provided a golf club head of 250 cc or more in volume and having a hollow construction, in which an arcuate length ($l_1$) from a front edge of a crown portion of the head to a front edge of a sole portion, a circumferential length ($l_2$) from the crown front edge through the back side to the sole front edge and a gravity depth (D) of the head in a cross section of the head in the direction of the head width at least in a sweet area of a front face, are in a relationship of $(l_2/l_1)\times D \leqq 100$ in the cross section.

According to the present invention, a gravity adjusting piece is secured in a predetermined position of the inner surface of the sole portion of the head to adjust the position of head center of gravity. The gravity adjusting piece has a bar-like shape extending on the inner surface of the sole portion in a position nearer to the front face of the head from the toe portion to the heel portion. Disposing the gravity adjusting piece allows the position of the center of gravity nearer to the front face and lower towards the sole portion (namely, shallow and low gravity), thereby permitting to drastically reduce back spins imparted to a golf ball when struck with the golf club head, and increase the initial angle of ball lifting. Thus, the reduced distance of ball flight frequently experienced by ordinary golfers can be prevented. Also, two such bar-like gravity adjusting pieces may be disposed separately, one in a position near the toe of the head and the other near the heel, to shift the center of gravity towards the front face of the head and increase the moment of inertia about a vertical axis through the center of gravity. That is, the center of gravity is placed nearer to the front face while being kept low so that appropriate back spins are imparted the golf ball struck with the club head, result in an increased distance of ball flight and the golf ball can be hit with an increased accuracy owing to the increased moment of inertia. Therefore, the golf club head according to the present invention shows appropriate characteristics suitable for various golfers having average, middle and high grades of skill.

Furthermore, there are disposed on the inner surface of the sole potion two gravity adjusting pieces (A) and (C) separately near the head front face while another piece (B) near the back side such that these pieces are in the relationship in weight of A+B≦C. Thus, the moment of inertia about a horizontal axis extending through the center of gravity form the heel to toe of the head is increased, contributing to an inhibited variation of the loft angle of the head when striking a golf ball with the head. It is expected that the golf ball will fly over a distance corresponding to the loft angle. Also, the moment of inertia about the axis of the club shat is decreased, so the golfers of middle and high skill can well control the golf club head.

These objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
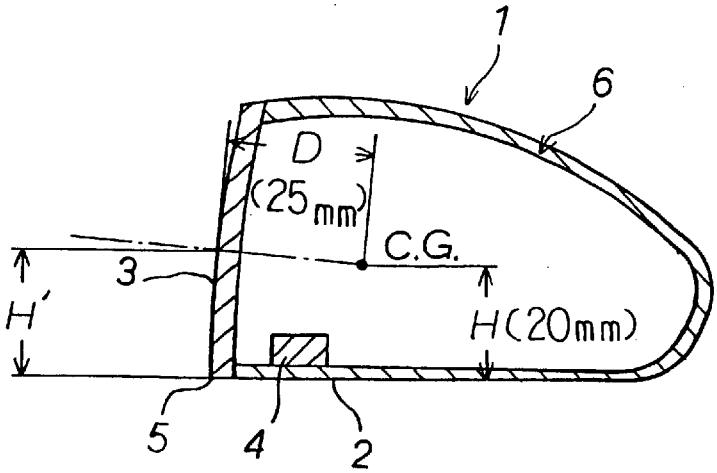
FIG. 1 is a sectional view taken along the line A—A in FIG. 2, of a first embodiment of the golf club head according to the present invention.

Referring now to the drawings, the preferred embodiments of the present invention are illustrated. Wherever possible, the same or like reference numerals are used to throughout the drawings to refer to the same or like parts.

Figure 2:
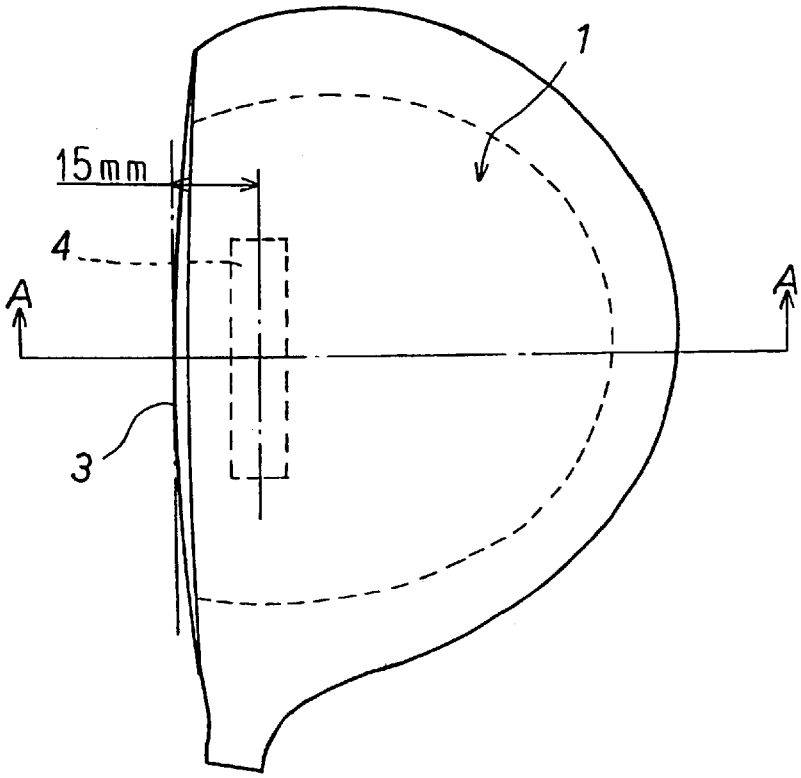
FIG. 2 is a plan view of the golf club head in FIG. 1.

FIGS. 1 and 2 show together the first embodiment of a golf club head of the present invention. In this embodiment, a head body is generally indicated with a reference numeral 1 It has a hollow construction made as a whole of a titanium alloy, and includes a sole portion 2 and a front face 3 having a leading edge 5 by those which a shell-like body 6 is formed. A prismatic gravity adjusting piece 4 made of titanium and having a width of 20 mm, a length of 50 mm and a weight of 20 g, for example, is welded to the inner surface of the sole portion 2 in a position nearer to the front face portion 3 and 15 mm off the leading edge 5. The front face 3 of the heady body 1 is 110 mm long and 49 mm high. The shell-like body 6, having a face member welded to the front thereof is 90 mm wide (including the thickness of the face member). In the head of this embodiment, the gravity depth D (length extended form the head center of gravity perpendicularly to the front face portion 3) is set 25 mm and the gravity height H is set 20 mm, for example.

Figure 3:
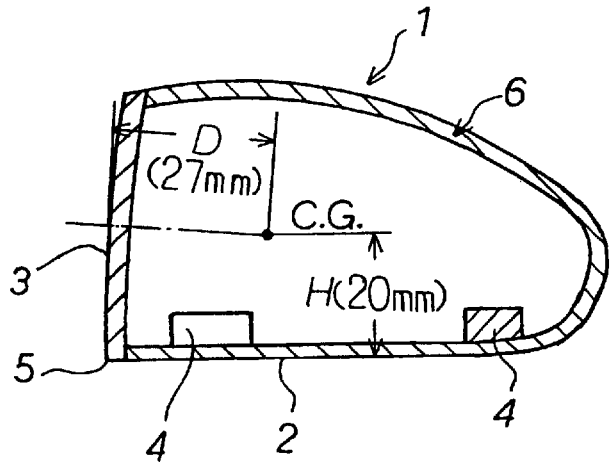
FIG. 3 is a sectional view taken along the line B—B in FIG. 4, of a second embodiment of the golf club head according to the present invention.
Figure 4:
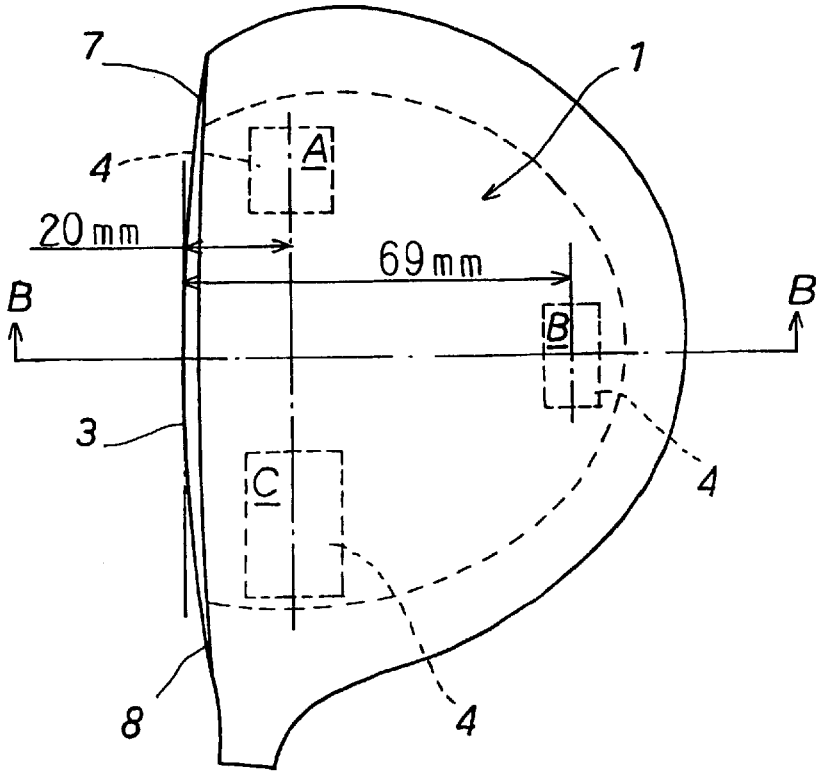
FIG. 4 is a plan view of the golf club head in FIG. 3.

FIGS. 3 and 4 show together the second embodiment of a golf club head according to the present invention. In this embodiment, the golf club head body 1 is made of titanium alloy and has a hollow-construction as in the first embodiment. Cubic gravity adjusting pieces 4 (A, B and C) are disposed on the inner surface of the sole portion 2. The two cubic gravity adjusting pieces 4 (A and C) are disposed symmetrically with respect to a line B—B passing through the center of the front face 3 of the head I and perpendicular to the front face 3. They are located nearer to the front face 3 in positions, respectively, 20 mm off the leading edge 5, one by the side of the toe portion 7 and the other by the side of the heel portion 8, as will seen from FIG. 4. A further cubic gravity adjusting piece 4 (B) is also disposed on the above-mentioned line B—B. It is located nearer to a back side portion of the head 1 is in a position 69 mm from the leading edge 5. Of the two gravity adjusting pieces 4 (A and C), piece 4 (A) is made of titanium, has vertical and horizontal dimensions both of 15 mm and a weigh of 9 g, and piece 4 (C) is also made of titanium, has a vertical dimension of 20 mm and horizontal dimension of 10 mm and a weight of 8 g. Note that the major dimensions of this head are same as those of the head in the first embodiment shown in FIG. 1. The gravity adjusting pieces 4 (A and C) and (B) are adjusted in weight to satisfy the relationship of A+B≦C for no increase of the gravity distance, such that the golfers having middle to upper grades of skill can control the club head more easily. In this embodiment, the gravity depth D is set 27 mm and gravity height H is set 20 mm.

Figure 5:
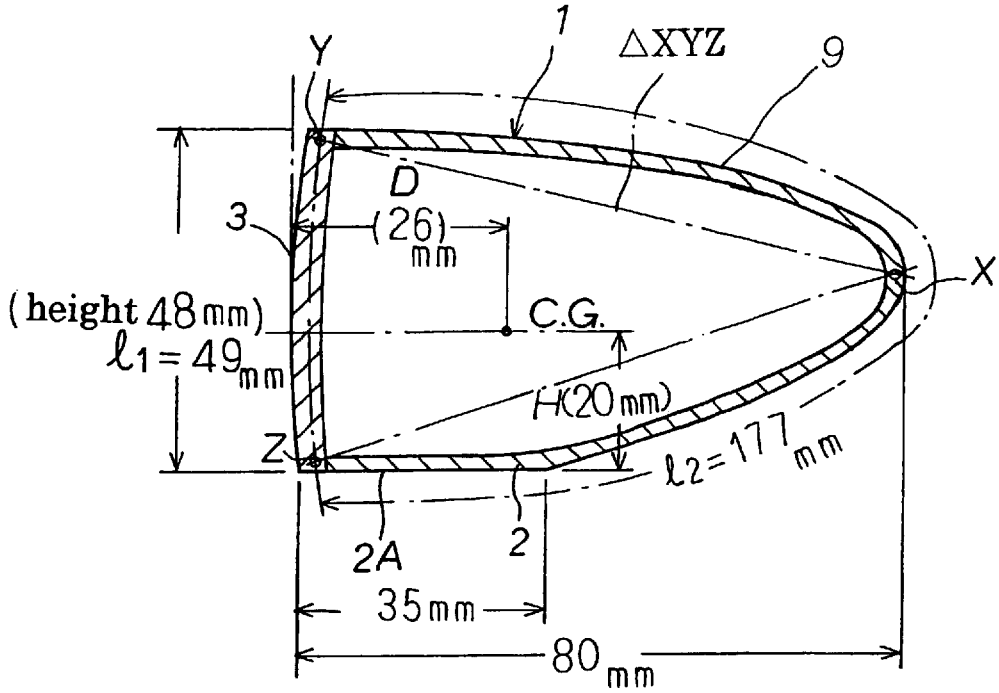
FIG. 5 is a sectional view of a third embodiment of the golf club head according to the present invention.

FIG. 5 shows a sectional view of the third embodiment of a golf club head according to the present invention. The head has a hollow construction made of titanium alloy. The head body 1 has a cross section taken in the direction of head width. The cross section is basically defined by a triangle (ΔXYZ) formed by the end of the back side as vertex X and a line YZ through the front face 3 as base. That is, the rearward portion of the head form the front face 3 is just an outward inflation of the triangle XYZ. It is assumed for this embodiment that an arcuate length of the front face 3 is $l_1$, a circumferential length of the portion of the heady body 1 except for the front face 3 (namely, including the crown and sole portion) is $l_2$ and a desired gravity depth is D. The front face length and the circumferential length are set to meet a relationship of $(l_2/l_1)\times D \leqq 100$. The sole portion 2 has, near the front face 3, a horizontal narrow surface 2A having a width of 35 mm and extending from the toe 7 to the heel 8, which will assure a stable placement of the head on the ground when addressing. The horizontal surface 2A should preferably be 50 mm of less wide. If the width exceeds 50 mm, the gravity depth D will be deeper in the head body 1. In this embodiment, the gravity depth D is et 26 mm and the face height is 48 mm (the arcuate length $l_1$=49 mm), and the circumferential length $l_2$ is set 177 mm to meet the dimensional relationship of $((l_2/l_1)\times D=93.9<100$. Since the cross section taken in the direction of head width at least in the sweet area has the triangular form, the head weight is distributed rather near the front face 3. Thus the center of gravity C.G. is located near the front face 3 and at a low position (20 mm) near the sole portion 2. In the cross section taken in the direction of head width in the sweet area of the front face 3, the arcuate length $l_1$ of the front face 3 from the front edge of a crown portion 9 to that of the sole portion 2, the circumferential length $l_2$ of the head body 1 from the front edge of the crown portion 9 to the front edge of the sole portion 2 via the back side, and the gravity depth D of the head, are set to meet the relationship of $(l_2/l_1)\times D \leqq 100$. In this golf club head, the center of gravity is positioned by defining the cross sectional shape of the head in the direction of head width. At least in the cross section in the sweet area of the front face 3, a relationship between the height of the front face 3, there is defined a relationship between the height of the front face 3 (the arcuate length) and the circumferential length of the head body 1 open at the front face 3. Namely, for the center of gravity positioned nearer to the front face, the height of the front face 3 has to be increased and the above-mentioned circumferential length of the had body 1 has to be reduced. The above relationship of $(l_2/l_1)\times D \leqq 100$ was found by the Inventor through the measurement and analysis of the dimensions and gravity positions of various types of golf club heads. For a given or desired gravity depth, this relationship can be used to determine a relationship between a height of the front face 3 and circumferential length of the head body 1, thereby permitting to roughly design a due shape of the head section for the desired gravity depth. By determining details within this rough design framework, it is possible to determine a sectional shape of the golf club head in which the head weight is distributed mainly near the front face 3, the center of gravity is also near the front face 3.

With the sole portion 2 of the golf club head having the generally horizontal surface 2A of 50 mm or less in width as measured form the leading edge 5 as in the above, the user can easily set the head in the direction of his target, namely, he will be able to easily address the head In this embodiment, the width of the horizontal surface 2A is set 50 mm or less as measured form the leading edge 5. If the width is more than 50 mm, the center of gravity of the head will shift towards the rear, namely, the center of gravity will be disadvantageously deeper.

Figure 6:
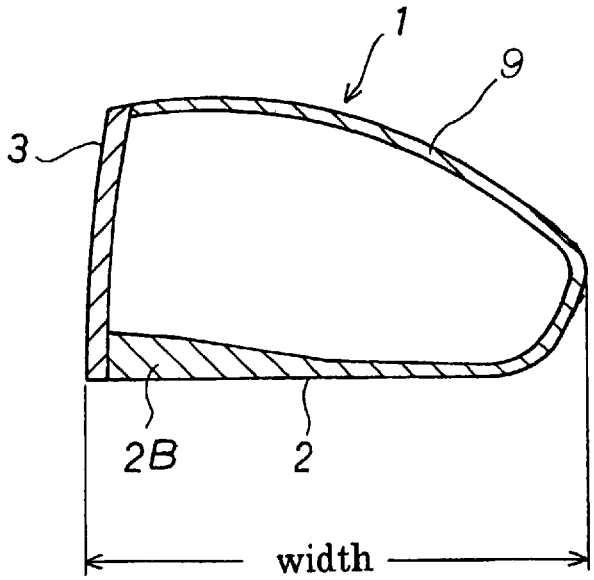
FIG. 6 is a sectional view of a fourth embodiment of the golf club head according to the present invention.

FIG. 6 is a sectional view of the fourth embodiment of the present invention, taken along a line through the center of the front face 3. In this embodiment, the sole portion 2 is thicker in a forward portion 2B thereof nearer to the front face 3 than a rearward portion as shown. The thicker portion 2B is generally a forward half of the sole portion 2, corresponding to a forward half of the head body 1. Thus, the weight of the sole portion 2 is distributed mainly near the front face 3 so that the center of gravity can be near the front face 3. In this case, the gravity is also positioned lower since the shift of the head weight to the front face side is conducted by the sole portion 2 itself.

In the aforementioned embodiments, the gravity depth D should be preferably 28 mm or less, gravity height H' (a minimum distance from the center of gravity on the front face 3 to the ground when the sole portion 2 is placed on the grounding during normal addressing) be 26 mm or less.

Figure 7:
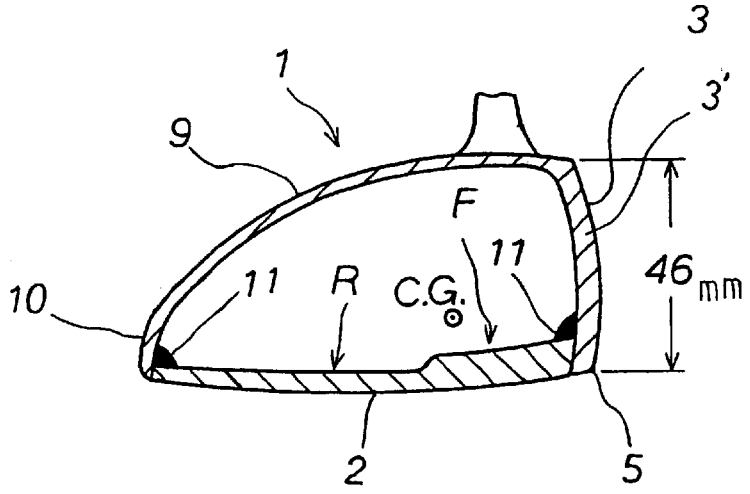
FIG. 7 is a sectional view of a fifth embodiment of the golf club head according to the present invention.

FIG. 7 is a sectional view of the head body 1 of a fairway wood according to the fifth embodiment of the present invention. The head is wholly made of stainless steel. More particularly, the sole portion 2 and other portion of the head body 1 are separately formed by casting. The sole portion 2 is welded at a position indicated with a reference 11 to the head body 1. The reference numeral 3' indicates a face member whose lower end is the leading edge 5. The crown portion 9 extends from the top end of the face member 3' to the a back side 10. The sole portion 2 includes a forward portion F near the face member 3' and a rearward portion R near the back side 10. In this embodiment, at least a portion of the forward portion F has a thickness two times or more greater than the average thickness of the rear portion R. The sole portion 2 in a plan view is defined as the outside surface of the head bottom portion gained by projecting an area surrounded by a vertical (imaginary) surface passing through a crossing line formed by intersection of said outside surface and the side face of the head, and the leading edge 5 of the front face 3 to the horizontal plain, when normally addressing a golf club with a due lie angle. The width of the forward portion F is obtained as an average width gained by measuring the length vertical to the front face 3 in the direction parallel to the sole width at respective points from the toe to heel. In the golf club head where the sole portion 2 is divided two part, namely the forward portion F and reward portion R, and at least a portion of the forward portion F is two times or more greater than the average thickness of the rearward portion R, the weight distributed on the sole portion 2 is concentrated at the forward portion F nearer to the front face 3 to lower the center of gravity. The center of gravity is positioned near the face member 3' so that the center of gravity on the front face 3, defined as a point where a line passing through the center of gravity of the head intersects perpendicularly the front face 3, is set at a lower position. Therefore, it will be impossible that the vertical moment of inertia is unbalanced by excessively increasing the weight of the sole portion 2. A low gravity can be obtained with an appropriate weight of the sole potion 2 without inducing unbalance of the vertical moment of inertia owing the excessive sole weight. Also, the mass removed from the sole portion 2 can be distributed to the crown portion, perimeter, the face member 3', etc. to make a further large head.

Figure 8:
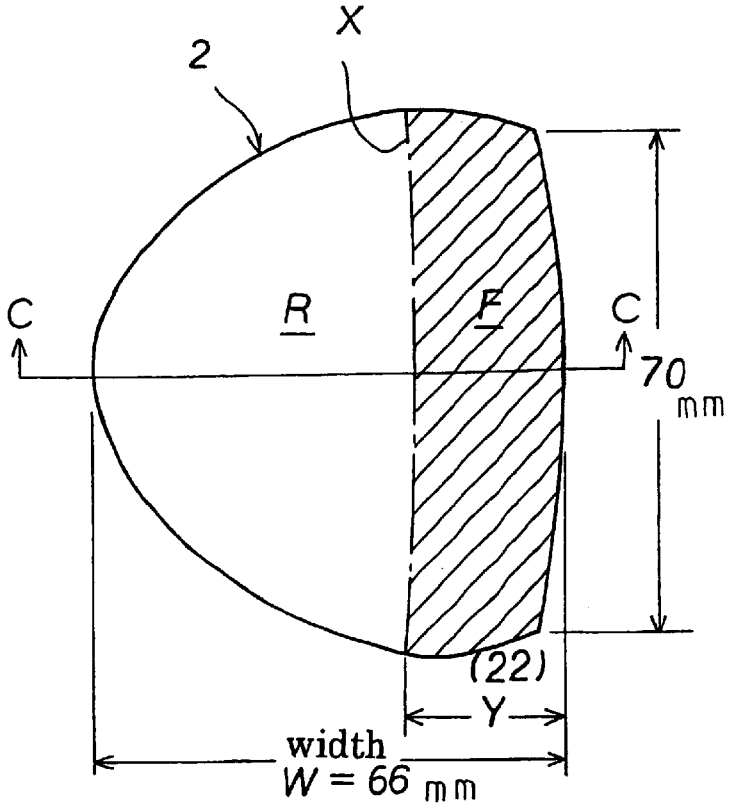
FIG. 8 is a plan view of the sole portion of the golf club head.
Figure 9:
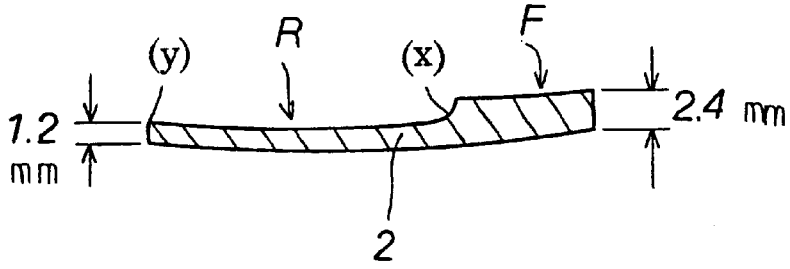
FIG. 9 is a sectional view taken along the line C—C in FIG. 8.

FIG. 8 is a plan view of the sole portion 2 of the fairway wood club head in FIG. 7 when the head is normally addressed keeping a lie angle designed for the golf club. FIG. 9 is a sectional view of the sole portion 2, taken along the line C—C in FIG. 8. As shown in FIGS. 8 and 9, the forward portion F of the sole 2 is located by the side of the face member 3' from a line (indicated with a dashed line and taken as boundary X herein) parallel to the leading edge 5 of the front face 3 and perpendicular to the direction of the sole width. The distance Y from the leading edge 5 to the boundary X is the width of the forward portion F and about ⅓ (22 mm) of the sole width (W=66 mm). The forward portion F has a uniform thickness. As shown in FIG. 9, the rearward portion R of the sole portion 2 is located by the side of the back side 10 from the boundary X. As will be seen from FIG. 9, the thickness of the forward portion F is uniform in that portion and two times larger than the average thickness of the rearward portion R (average thickness of a portion from a point (x) to (y) in FIG. 9 is 1.2 mm), thus it is 2.4 mm.

It should be noted that the front face 3 is 70 mm long and the face member 3' is 46 mm high. The center of gravity (C. G.) of the golf club head having the aforementioned construction according to the present invention is positioned set in a lower position near the face member 3' as shown in FIG. 7, so that the center of gravity on the front face 3 is positioned low. Thus, the fairway wood club head in this embodiment will be able to effectively lift a golf ball high for an increased distance of flight.

Figure 10:
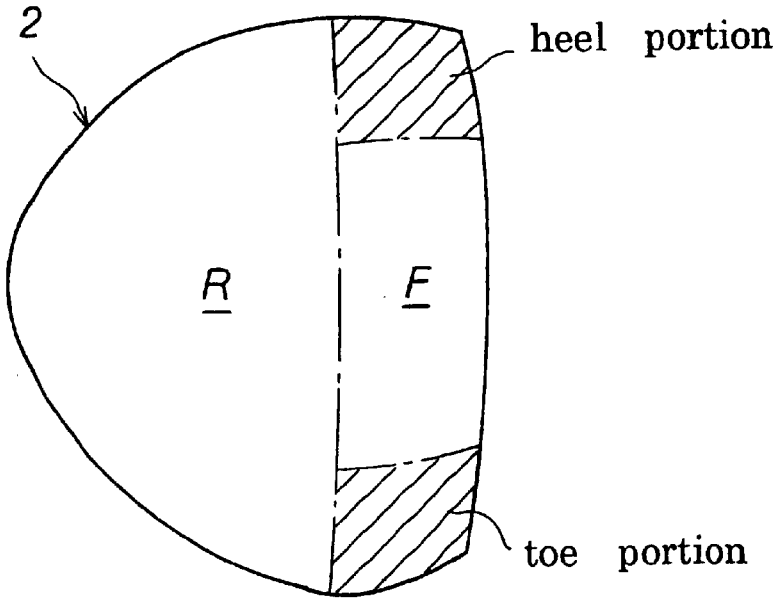
FIG. 10 is a plan view of the sole portion of another embodiment of the golf club head according to the present invention.

FIG. 10 shows a further embodiment of the present invention. In this embodiment, the toe and heel portions in the forward portion F of the sole portion 2 are formed further thicker, namely, 3.0 mm. And the rest of the forward portion F is 1.2 mm thick as in the rearward portion R. The total area of these thick toe and heel portions is 40% of the total area of the forward portion F.

In addition to the above-mentioned effect, the aforementioned thick toe and heel portions in the forward portion F of the sole portion 2 increase the lateral moment of inertia about a line passing through the head center of gravity and perpendicular to the ground, whereby a golf ball hit with the club head will flight stably without much deviation from an intended direction.

What is claimed is:

1. A golf club head having a hollow construction, a forward area of a sole portion of the head as viewed from above, that is nearer to a front face of the head, having a thickness in at least a portion thereof which is two or more times greater than an average thickness of a rearward area of the sole portion, that is nearer to a back side of the head;

wherein a crown portion extends from a top end of the front face to the back side of the head; and wherein the sole portion is separately formed and welded to said front face and crown portion on interior surfaces of said front face and crown portion.

2. The golf club head as set forth in claim 1, wherein the forward area of the sole portion has a width smaller than one half of the sole width measured from the leading edge of the front face to the back side end.

3. The golf club head as set forth in claim 2, wherein the total area of the thick portion of the forward area is 25% or more of the forward area.

4. The golf club head as set forth in claim 2, wherein portions of the forward area that are closer to the toe and heel, respectively, are thicker than remaining portions of the forward area which are farther from the toe and heel.

5. The golf club head as set forth in claim 1, wherein the total area of the thick portion of the forward area is 25% or more of the forward area.

6. The golf club head as set forth in claim 5, wherein portions of the forward area that are closer to the toe and heel, respectively, are thicker than remaining portions of the forward area which are farther from the toe and heel.

7. The golf club head as set forth in claim 1, wherein portions of the forward area that are closer to the toe and heel, respectively, are thicker than remaining portions of the forward area which are farther from the toe and heel.

8. A golf club head having a hollow construction comprising:

a face portion, a crown portion, and a sole portion, wherein a forward area of the sole portion of the head as viewed from above, that is nearer to a front face of the head, having a thickness in at least a portion thereof which is two or more times greater than an average thickness of a rearward area of the sole portion, that is nearer to a back side of the head;

wherein the sole portion is thicker in the forward area than the rearward area, and said forward area of the sole portion gradually decreases in thickness from said face portion.

9. A golf club head having a hollow construction, a forward area of a sole portion of the head as viewed from above, that is nearer to a front face of the head, having a thickness in at least a portion thereof which is two or more times greater than an average thickness of a rearward area of the sole portion, that is nearer to a back side of the head;

wherein a crown portion extends from a top end of the front face to the back side of the head;

wherein the sole portion is thicker in the forward area than the rearward area, and said forward area of the sole portion gradually decreases in thickness from said face portion; and wherein the sole portion is separately formed, and welded to said front face and crown portion on interior surfaces of said front face and crown portion.

* * * * *